US006733279B2

(12) United States Patent
Thigpen et al.

(10) Patent No.: US 6,733,279 B2
(45) Date of Patent: May 11, 2004

(54) REMOTE MICROCONTROLLED LASER OIL LAMP

(76) Inventors: Harold D. Thigpen, 1732 S. Congress Ave. # 327, Lake Worth, FL (US) 33461; Andrew Schmidt, 2633 Maunawai Pl., Unit C, Honolulu, HI (US) 96826

( * ) Notice: Subject to any disclaimer, the term of this patent is extended or adjusted under 35 U.S.C. 154(b) by 31 days.

(21) Appl. No.: 10/078,338

(22) Filed: Feb. 21, 2002

(65) Prior Publication Data

US 2002/0146656 A1 Oct. 10, 2002

Related U.S. Application Data

(60) Provisional application No. 60/281,375, filed on Apr. 5, 2001.

(51) Int. Cl.[7] ..... E23D 3/02
(52) U.S. Cl. ..... 431/253; 431/298
(58) Field of Search ..... 431/18, 33, 253, 431/261, 262, 289, 298, 260, 344

(56) References Cited

U.S. PATENT DOCUMENTS

| | | | | | |
|---|---|---|---|---|---|
| 966,328 | A | * | 8/1910 | Hacker | 431/262 |
| 1,317,069 | A | * | 9/1919 | Porter | |
| 3,905,746 | A | * | 9/1975 | Patrikios | |
| 4,422,845 | A | * | 12/1983 | Yamaguchi | |
| 4,526,530 | A | * | 7/1985 | Menter et al. | 431/321 |
| 4,563,150 | A | * | 1/1986 | Nilsson | |
| 4,728,286 | A | * | 3/1988 | Olsen | |
| 4,781,577 | A | * | 11/1988 | Stewart | |
| 4,875,852 | A | * | 10/1989 | Ferren | |
| 4,962,750 | A | * | 10/1990 | Bridgewater | |
| D316,152 | S | * | 4/1991 | Barbuto | |
| D359,369 | S | | 6/1995 | Caplette et al. | |
| 5,797,739 | A | * | 8/1998 | Lioi | 431/344 |
| 5,806,973 | A | * | 9/1998 | Porter | 362/412 |
| 5,899,685 | A | * | 5/1999 | Thigpen | |
| D411,633 | S | | 6/1999 | Boss | |
| D413,172 | S | | 8/1999 | Belschner | |
| 6,491,516 | B1 | * | 12/2002 | Tal et al. | 431/253 |

FOREIGN PATENT DOCUMENTS

| | | | |
|---|---|---|---|
| DE | 10131270 C1 | * | 11/2002 |
| GB | 2 083 198 A | * | 3/1982 |
| GB | 2261965 A | * | 6/1993 |
| JP | 55-3574 | * | 1/1980 |
| JP | 5-228268 A | * | 9/1993 |

* cited by examiner

*Primary Examiner*—SAra Clarke
(74) *Attorney, Agent, or Firm*—Richard C. Litman

(57) ABSTRACT

A remote micro-controlled oil lamp having a base with a crystal housing for a electrically activated wick is described. Mounted within the base is a coupled photodetector and audio circuit which respectively receives and transmits signals for lighting the wick and sounding a prerecorded message to signify an on and off condition. The wick is provided in the form of a pair of electrodes which are electrically activated via the photodetector by a remote laser source and/or a manual switch mounted within the base. When the lamp is either remotely or manually activated the electrodes generate a spark across a combustible fluid filled cylindrically shape gap as a catalyst to produce a candle light or flame. A micro-pump circuit is mounted within the base of the reservoir to ensure an adequate supply of fuel for an extended source of candle light.

17 Claims, 6 Drawing Sheets

REMOTE MICROCONTROLLED LASER OIL LAMP

CROSS-REFERENCE TO RELATED APPLICATION

This application claims the benefit of U.S. Provisional Patent Application Serial No. 60/281,375, filed Apr. 5, 2001.

BACKGROUND OF THE INVENTION

1. Field of the Invention

The present invention relates generally to oil lamps. More specifically, the invention is a remote micro-controlled oil lamp having a electrically controlled wick and audio circuit for igniting and signalling wick illumination and deactivation.

2. Description of Related Art

Numerous oil lamps have been devised which include the use of a variety of different mechanisms for either extinguishing and activating a flame or controlling the time in which light from a lamp is provided. U.S. Pat. No. 1,317,069 issued to Burchfiel discloses a time controlled lamp lighting device having an alarm clock mounted therein. As earliest as Sep. 23, 1919, time control features have been found necessary for minimizing manual manipulation of lamps, however, most lamp features then were prone to mechanical limitations requiring manual use of mechanical elements such as springs and winding mechanism for activation.

As early as Sep. 16, 1975, the need for automatic extinguisher mechanisms or features was still wide spread and unfulfilled. In this regard, U.S. Pat. No. 3,905,746 issued to Patrikos sought to fulfill this need by disclosing a fuel body container having two sources of stored energy (i.e. spring like mechanisms) which also worked primarily by mechanical principles for manual manipulation.

These conventional lamps as further described hereinbelow undergo material failure due to the use of mechanical elements such as springs and the like, which suffer from cyclical material fatigue or loss of recoil or compression. Also, such lamps utilize a material wick which has the tendency more often than not, to lack a sufficient level of fuel saturation for maintaining a flame. The remote micro-controlled laser oil lamp as herein described does not suffer the aforementioned problems and has flexible utility for indoor and outdoor use with virtually no wicker or flame dissolution.

Patents respectively issued and granted to Yamaguchi (U.S. Pat. No. 4,422,845 and UK 2083198) disclose a liquid hydrocarbon burner of the type having a vertically adjustable wick comprises an inner ring on which the wick is mounted, an intermediate ring outside the inner ring and an outer ring outside the intermediate ring. The rings are relatively rotatably and relatively vertically movable. Guide pins are disposed in slots formed in the rings so that when the outer ring is rotated, the inner ring moves vertically. This relative motion between rings is used to ignite supplied gas lowering and raising the wick.

U.S. Pat. No. 4,563,150 issued to Nilsson discloses an illuminating device which is operated on an inflammable liquid fuel and which comprises a container, burner and a wick arranged in the burner. The container has provided therein one or more opening for balancing pressure within the container. The burner is arranged to co-act with a shield which in a working position, permits the flame to burn freely, while in the event of the position of the device being radically changed is brought into abutment with the free end of the wick and extinguishes the flame.

U.S. Pat. No. 4,728,286 issued to Olsen discloses a lamp for liquid fuel comprising a fuel container, a wick support connected to an opening in the container and a wick supported by the wick support and connected to the container, such that fuel can be led by capillary forces from the container to the wick support.

U.S. Pat. No. 4,781,577 issued to Stewart discloses a fuel bottle with a candle-like attachment disposed at the upper neck portion of the bottle. The upper neck portion is configured to removably receive a top for closing or enclosing fuel stored therein. A wick is adjustably carried by a member forming part of the attachment for vertical adjustment with respect to the main body of the attachment. The wick is arranged so that, when the attachment is coupled to the neck of the bottle, the wick extends downwardly into the liquid fuel stored therein. When the top is removed the wick is exposed for lighting.

U.S. Pat. No. 4,875,852 issued to Ferren discloses a lamp device having a fuel reservoir consisting of a metal top and plastic bottom with a wick extending upward from the reservoir. A shell surrounds the reservoir and is removably attached to the fuel reservoir so that the fuel reservoir may be pulled from the bottom of the support and the amount of fluid observed through a plastic portion of the reservoir.

U.S. Pat. No. 4,962,750 issued to Bridgewater discloses a remote controlled fireplace burner. The ignition source is controlled by a hand held remote transmitter of radio frequency (RF) or infrared wave energy which activates a valve means to effect a supply of fuel for subsequently igniting the pilot. The igniter is connected to an igniter module constructed to produce a response to the reception of a signal from the transmitter. A receiver incorporates a relay which temporarily closes to transmit electrical energy from a 24 volt source to the module.

U.S. Pat. No. 5,899,685 issued to Applicant discloses a remote light wick extinguisher that uses the movement of air to extinguish candle light flames. Energy as described by Thigpen is sent from a transmitter to a remote receiver. The receiver actuates a circuit, such as a mono-stable multivibrator or one shot producing a pulse. The pulse, having sufficient amplitude and duration, actuates a transducer, similar in function to a speaker.

Other patent documents issued and respectively granted to Barbuto (Des. 316,152), Caplette et al. (Des. 359,369), Boss (Des. 411,633), Belschner (Des. 413,172) and Mori (JP 553574) are directed to ornamental wick features saturated by conventional means of liquid bath fuel.

None of the above inventions and patents, taken either singly or in combination, is seen to describe the instant invention as claimed.

SUMMARY OF THE INVENTION

The remote micro-controlled oil lamp according to the invention has a base with a crystal housing and reservoir for an electrically activated wick. Mounted within the base is a coupled photodetector and audio circuit which respectively receives and transmits signals for lighting the wick and sounding a pre-recorded message to signify an on/off condition. The wick is provided in the form of a pair of electrodes which are electrically activated via the photodetector by a remote laser source and/or a manual switch mounted within the base. When the lamp is either remotely or manually activated the electrodes generate a spark across a combustible fluid filled cylindrically shaped gap as a catalyst to produce a candle light or flame. The candle light is maintained by a fuel channel bath separately disposed between a pair of electrodes which are centrally arranged within a reservoir and centrally mounted to the base. A micro-pump circuit is also disposed within the base of the reservoir to ensure an adequate supply of fuel from the reservoir up through the cylindrically shaped fuel channel for spark activation.

Accordingly, it is a principal object of the invention to provide a remote micro-controlled oil lamp for supplying an extended source of candle light without wick deterioration.

It is another object of the invention to provide a remote micro-controlled oil lamp which is remotely activated and deactivated.

It is a further object of the invention to provide a remote micro-controlled oil lamp which audibly supplies a message indicating an on/off condition of the lamp.

Still another object of the invention is to provide a remote micro-controlled oil lamp which continually supplies a combustible oil or fuel via micro-controlled micro-pump.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
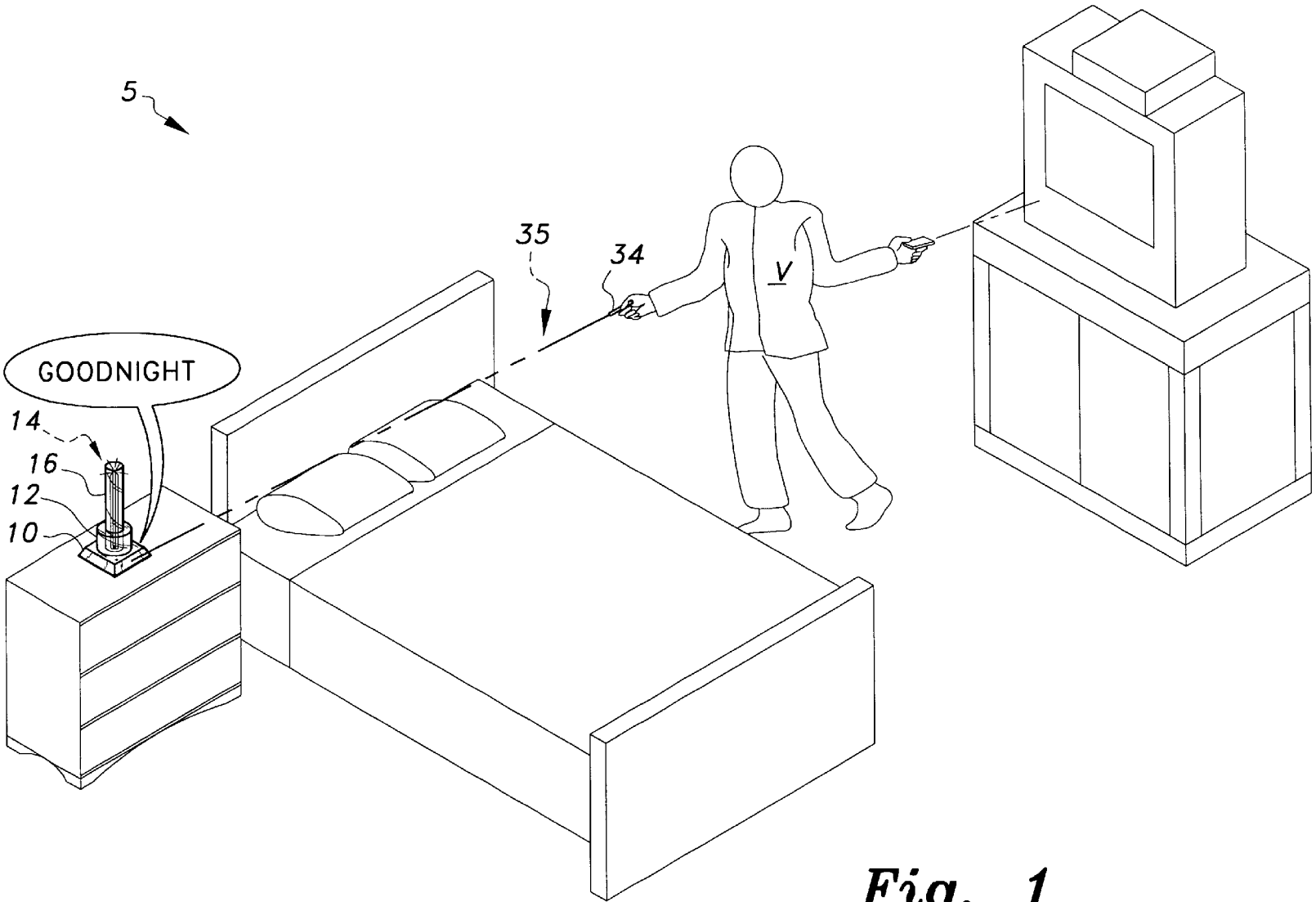
FIG. 1 is an environmental, perspective view of a remote micro-controlled laser oil lamp according to the present invention.
Figure 2:
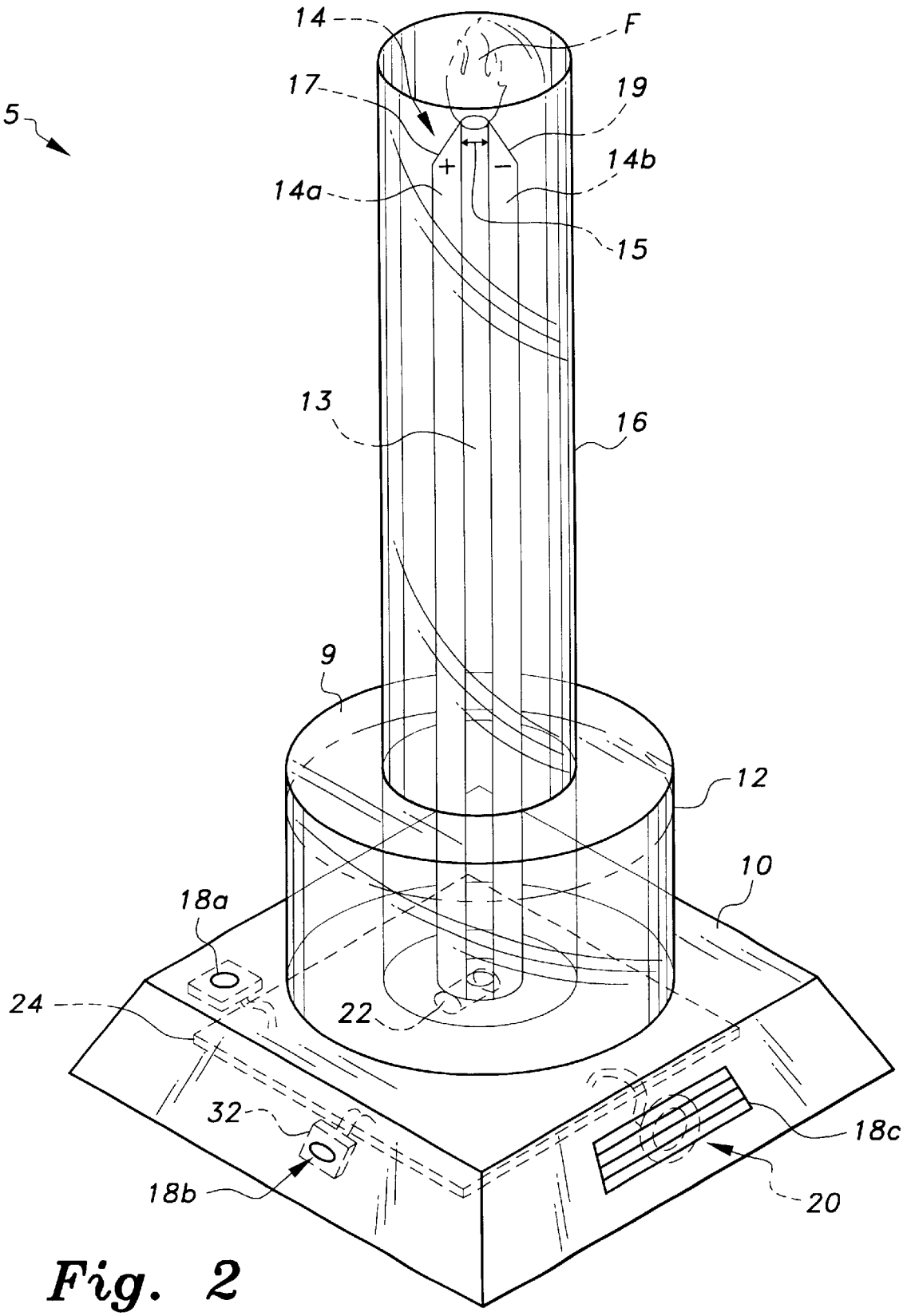
FIG. 2 is a perspective view of the remote micro-controlled laser oil lamp according to the invention.

The present invention is directed to a remote micro-controlled oil lamp system which utilizes a common underline illumination source and/or laser pointer (having a red, green, blue, etc. characteristic wavelengths) for selectively activating and deactivating the system. The preferred embodiment of the present invention is depicted in FIGS. 1 and 2, with alternative circuit embodiments depicted in FIGS. 3–4C. The preferred embodiment is generally referenced by numeral 5.

As best seen in FIGS. 1 and 2, the remote micro-controlled oil lamp system 5 comprises a base 10 having a reservoir 12 filled with combustible fluid 9 such as butane or a liquid paraffin, a wick 14 and a housing 16 for the wick 14. The wick 14 is unconventional in that it is not a liquid fuel saturated wick 14. The remote micro-controlled oil lamp system 5 preferably includes a wick 14 having a first 14*a* and second 14*b* electrode formed with an integral liquid fuel filled channel 13. The first and second electrodes 14*a*,14*b* are integrally mounted to opposing walls of the channel 13 such that a gap 15 of predetermined distance is formed as a pilot. Each electrode 14*a*,14*b* is a substantially rectangular electrode which tapers to convergent ends 17 and 19, respectively at an end of the wick 14 opposite the base 10. The gap or pilot 15 formed therein has spatial dimensions according to a selective diameter and differential length uniformly formed along the length of the channel 13.

In other words, the diameter of the channel 13 is substantially uniform throughout and along the entire length of the wick 14. Where the electrodes 14*a*,14*b* converge, a spark is generated across the gap 15 filled by a combustible differential fuel volume element for effecting extended "candle light". Accordingly, it is preferred that the channel 13 be configured as a substantially cylindrical channel 13 for providing spatial pilot clearance or gap 15 of combustible liquid fuel to form a flame F adjacent to the tapered ends 17,19 of the electrodes 14*a* and 14*b*, respectively. The tapered ends 17,19 converge at a top portion of the wick 14 in a direction opposite with respect to the base 10.

As schematically illustrated in phantom lines, the base 10 of FIG. 2 further includes dual activation circuit elements 18*a* and 18*b*, audible circuit element 20, and a means or micro-pump 22 operatively and integrally mounted to a circuit board 24 for pumping a combustible fluid from the reservoir 12 through the channel 13 integrally formed within the wick 14 via a micro-controller 26. This particular feature is further illustrated in FIG. 3 by the system conceptual circuit 30.

Figure 3:
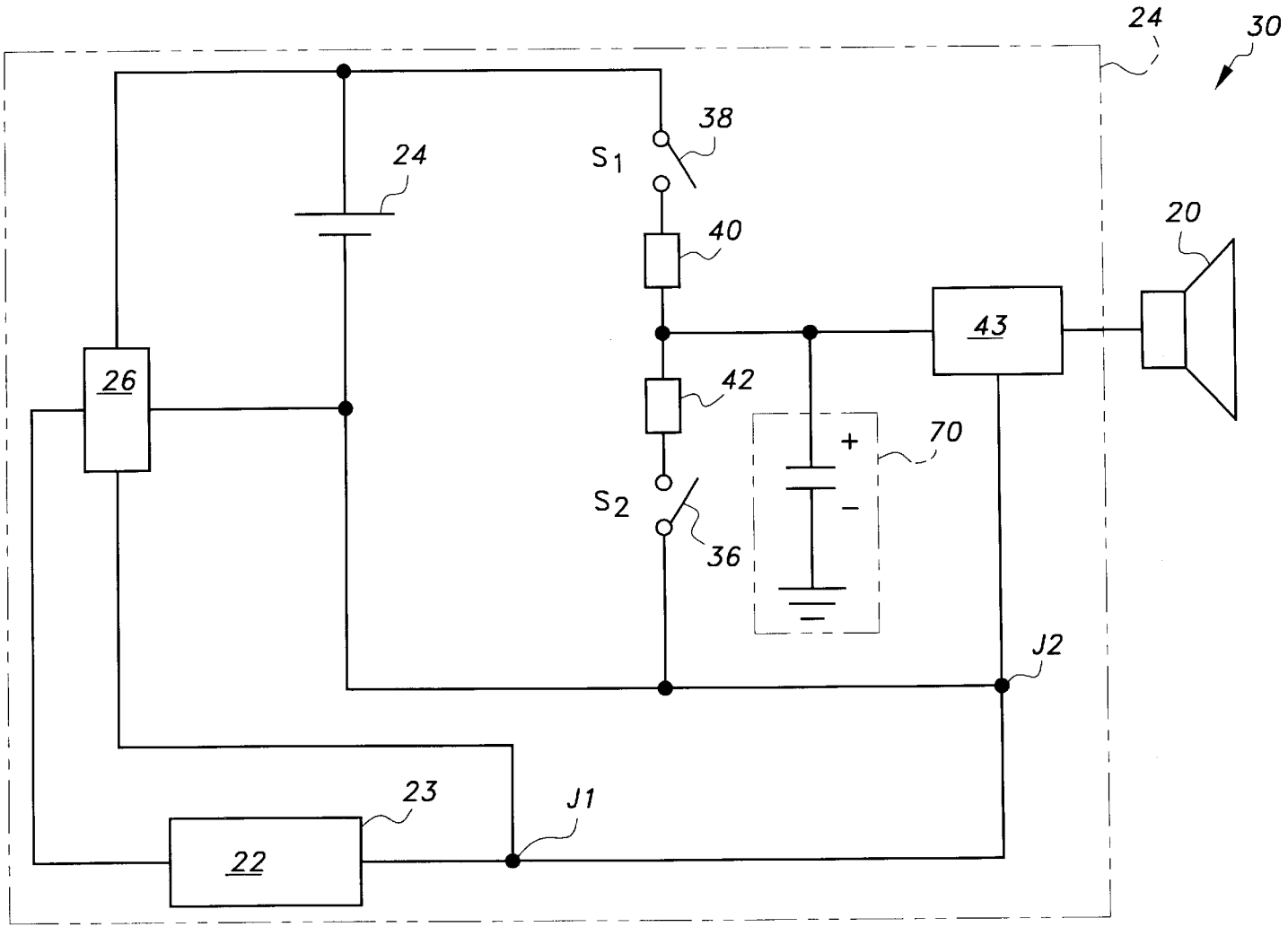
FIG. 3 is a conceptual circuit diagram of the micro-controlled laser oil lamp according to the present invention.

As shown in FIG. 3, a micro-controller 26 is operatively connected to the pump module 23 which includes a power source 25. The pump 22 is preferably a micro-pump which can be powered via rechargeable or disposable batteries as a direct current (DC) power source 25. The pump 22 is operatively connected thereto for supplying pumping power to a liquid fuel or liquid paraffin 9 stored within the wick 14. With respect to the flow level of the fuel 9, the controller 26 regulates the fuel flow up through the channel 13 via junction point $J_1$ with fuel overflow returned by gravity to the reservoir 12.

Figure 4A:
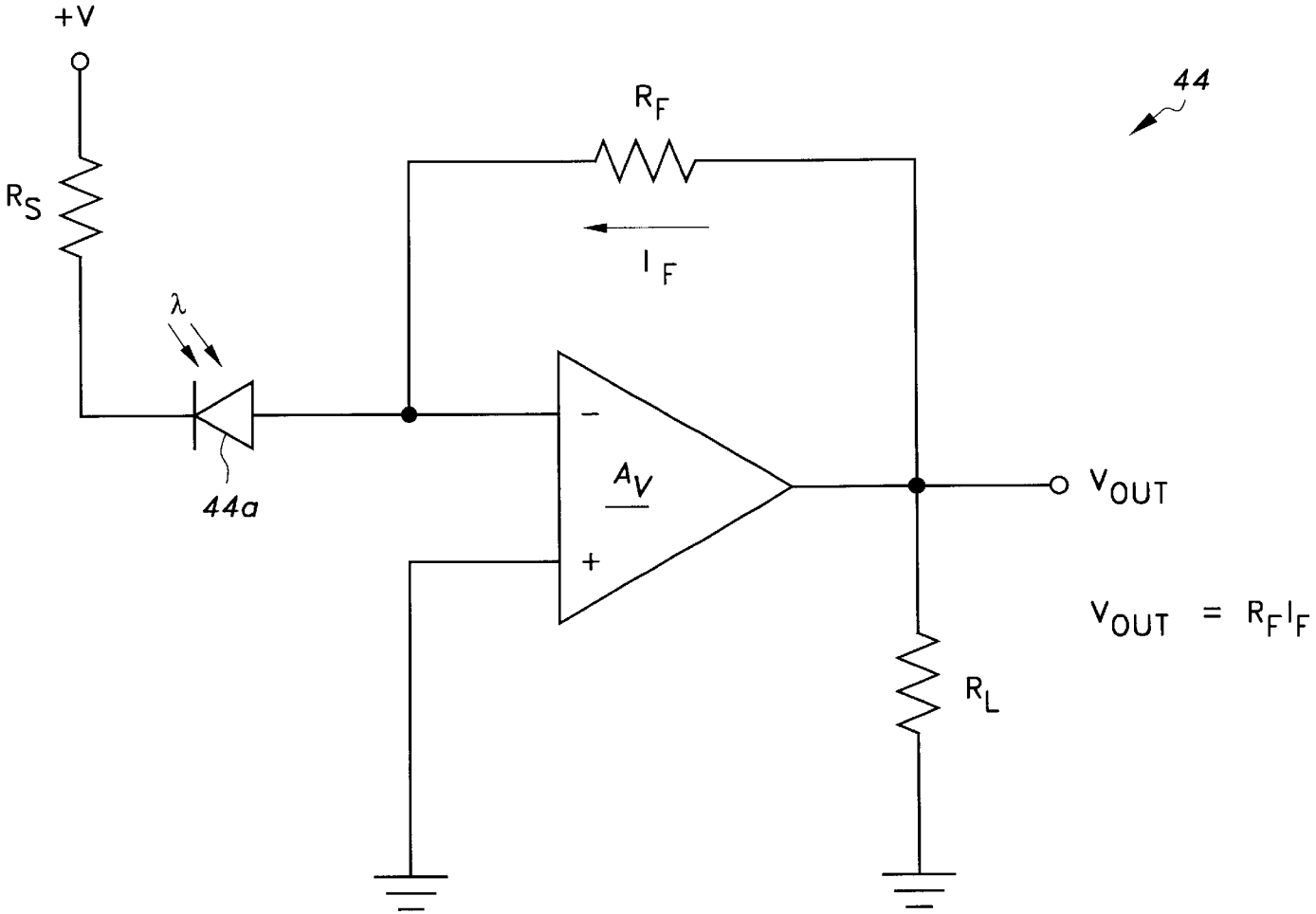
FIG. 4A is an exemplary light detecting circuit diagram according to a first embodiment.

For remote activation, the lamp system 5 detects via photodetector 32 through the aperture 18*b* a predetermined transmitted signal from the hand held remote laser unit 34. This unit 34 is selectively configured to transmit a beam 35 having a predetermined characteristic wavelength of known sensitivity. The transmitted signal or beam 35 is calibrated according to the sensitivity of the receiver or photodetector means 32. Any number of available detecting systems can be used according for detecting transmitted signals according to a selective sensitivity from the remote illumination or laser source 34. Accordingly, the received signal activates a first relay switch 36 which supplies power to the circuit 30. For manual operation a similar relay switch mechanism 38 is used for manually activating the circuit 30, except that this switch 36 is activated via a push button mechanism 18*a*. The push button mechanism 18*a* operates purely as a mechanical switch which utilizes conventional spring loaded button mechanisms for opening and closing typical circuit switches. Each relay switch 36,38 is coupled to an audible circuit element or speaker 20 via acoustic aperture 18*c* for selectively initiating a prerecorded message respectively. The sequencing of the sounded message is controlled by the microprocessor or controller via condition counters 40 and 42 which supplies a single sequenced counter signal to an audio circuit module 43 to identify an on/off message condition controlled by the micro-controller 26 via junction point $J_2$. When either relay switch is on or hi (i.e. "1"), the audible circuit provides an audible signal "Extended Candle Light". When either relay switch is off or lo (i.e. "0"), the audible circuit provides an audible signal "Good Night". Any number of messages can be recorded in this fashion on a micro-chip as a prerecorded message by the manufacturer or customized by a user U via conventional recording techniques. Since these techniques are well known to one having ordinary skill in the relevant art, the audible circuit can be easily adapted to provide recording features via a two-way speaker/microphone arrangement, etc. which is operatively linked to a micro-chip or similar message storage medium to provide the intended purpose. As schematically illustrated in FIG. 4A, a conventional light detecting circuit or photo-diode amplifier 44 is shown as an exemplary first embodiment or analog for detecting an incoming or transmitted "light" signal having a predetermined wavelength for activating the conceptual circuit 30 at switch $S_2$ according to the invention. As shown therein light λ strikes a diode 44*a* which subsequently supplies an induce voltage signal $V_{out}$ for subsequent processing by the counter and/or timing circuitry which initiates an audible signal.

Figure 4B:
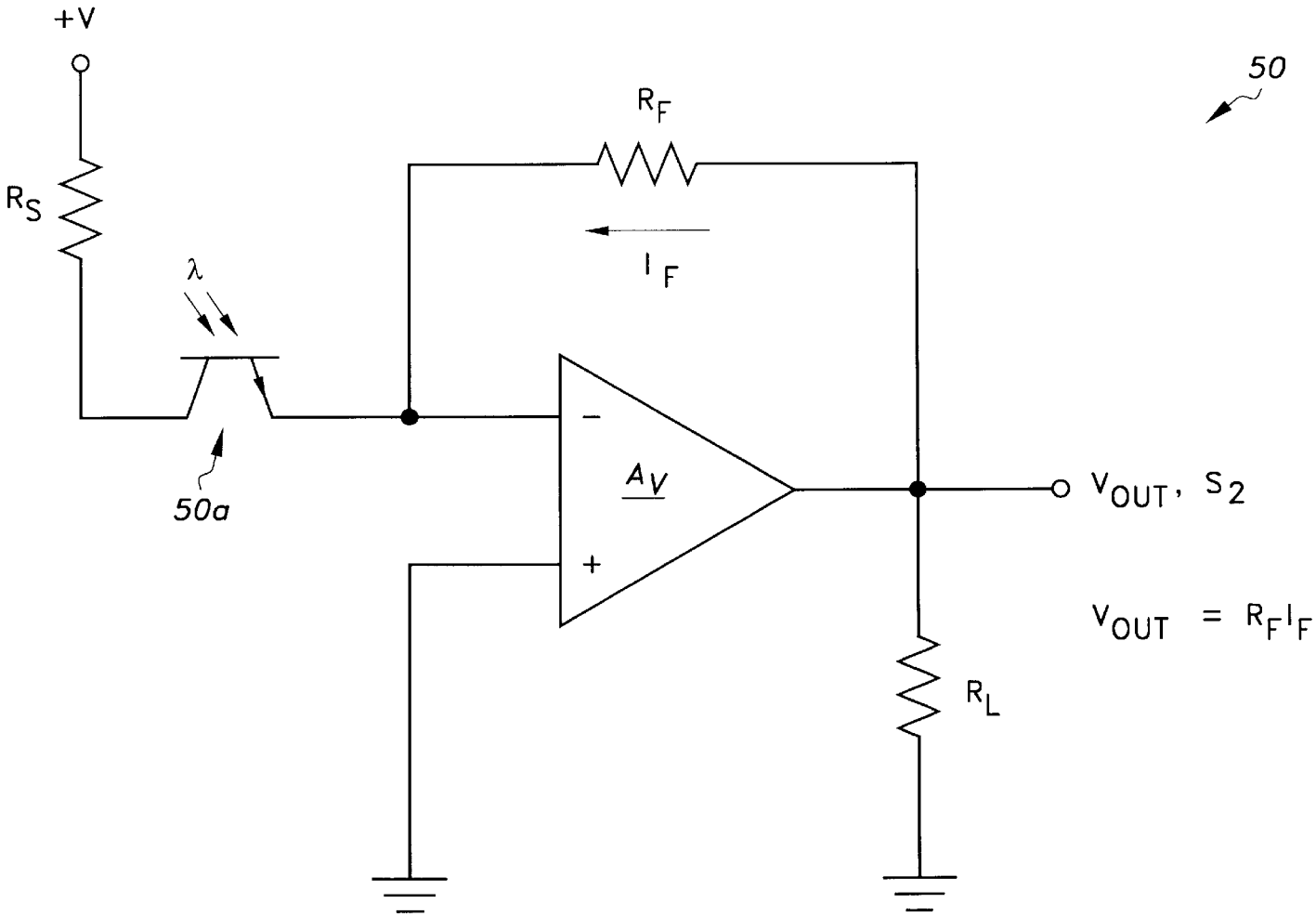
FIG. 4B is a exemplary light detecting circuit diagram according to a second embodiment.

As schematically illustrated in FIG. 4B, an exemplary phototransistor circuit 50 is shown. The same action performed by the light detecting circuit 44 will occur for the phototransistor circuit 50, when light λ strikes the phototransistor 50*a*. Both circuits 40 and 50 produce signals which ar amplified by means of an operational amplifier $A_v$ which supplies an output signal $V^{out}$ to a respective electrode of the wick 14 depending upon current $I_F$ drawn through resistor $R_F$. Step down resistors $R_s$ and load resistors $R_L$ have also been incorporated to control or maintain a respective input voltage and amplifier gain according to the general relation or formula:

$$A_v = -R_F/R_{in},$$

where Rin is the input resistance. When the input resistance $R_{in}$ decreases, the amplification $A_v$ increases. A photoresistor circuit (not shown) provides a similar effect based on the same principles recited above. Where appropriate power booster(s) 70 can be incorporated in the event more power-handling capability is needed. This particular feature is capable of moderate loads with a transistor pus-pull circuit which would allow the output voltage $V_{out}$, $S_2$ to swing nearly to a maximum voltage (with positive and negative amplitudes) supply and be able to handle more current.

Figure 4C:
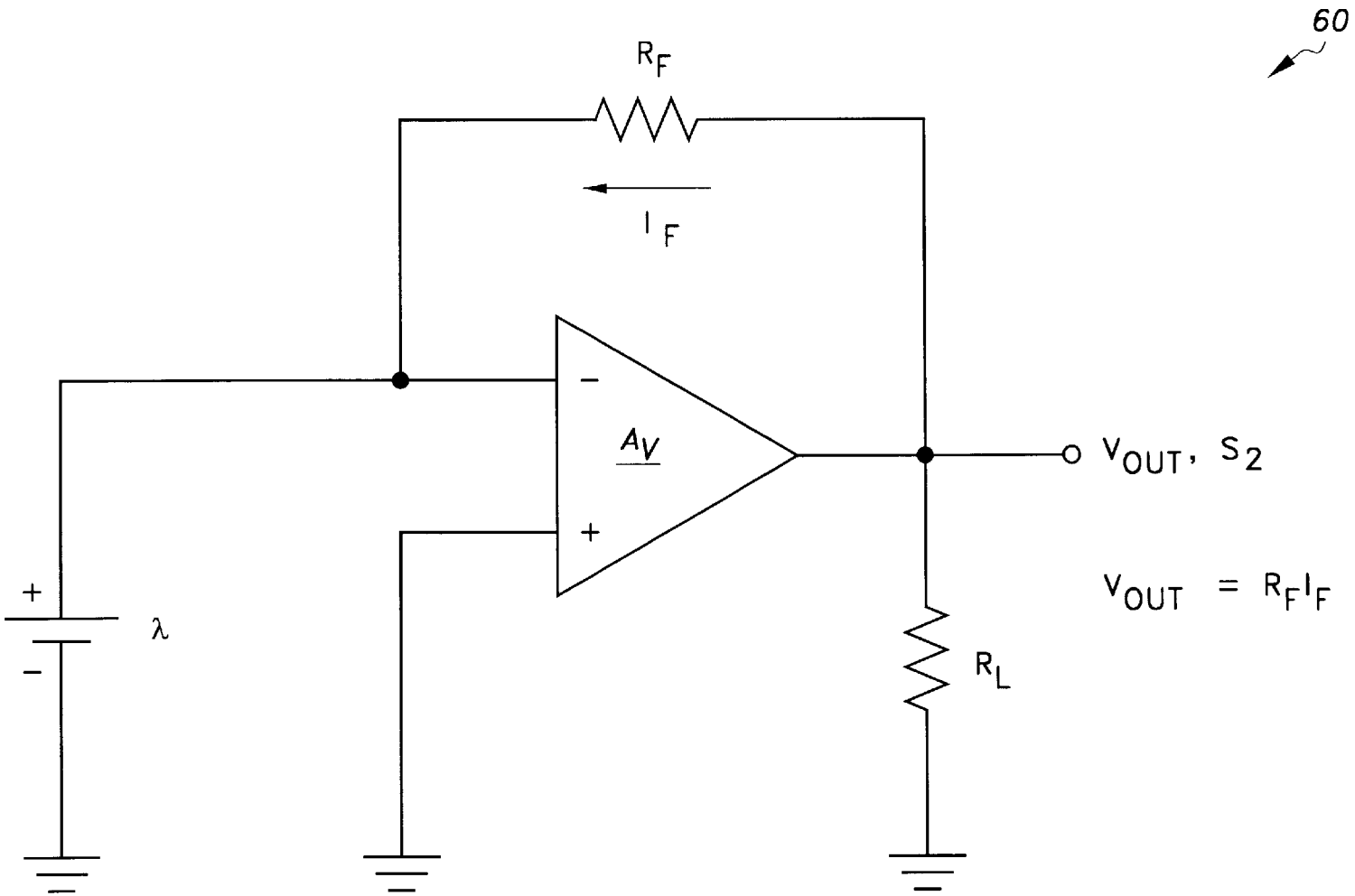
FIG. 4C is a exemplary light detecting circuit diagram according to a third embodiment.

As schematically illustrated in FIG. 4C, a conventional light detecting circuit or solar cell circuit 60 is shown according to third embodiment of the invention. The solar cell circuit 60 is similar to the previously mentioned circuits, although its operation is somewhat different. The solar cell sees essentially a short circuit, since the inverting input is a virtual ground. The current generated by the solar cell is proportional to the light λ striking its surface. The current is converted to a voltage signal by $R_F$ as given by the formula.

With respect to material properties of the lamp system 5, the base 10 is preferably made of a black onyx material with a substantially pentagonal structure. The reservoir 12 and housing 16 is made of a durable lead crystalline material with optional spillage preventive features or mechanisms. The reservoir and housing are attached to the base by conventional means utilizing adhesives and/or mechanical fasteners. In this regard, it is preferred that the reservoir 12, wick 14 and housing 16 are disposed on the base 10 as nested concentrically arranged elements.

The significant advantages of the lamp system 5 are realized in that a user U is able to remotely ignite a not only a single oil lamp, but a plurality of liquid oil candles using a common laser pointer source (usually <5 mw). Secondly, this is easily performed by simply scanning the transmitted beam 35 from a distance (about 100 feet) in the direction of the receiver 32 disposed in the base 10, and the wick 14 at the gap 15 is ignited. With a second activated pass or scan the respective relay or flip-flop switch places the micro-chip or processor 26 in a sleep mode.

In detail, the igniting components butane or an aromatic liquid paraffin are stored in the reservoir 12 until activated by the micro-pump 22 via a micro valve. The micro-controller 26 generates a 15 kHz signal to the micro-pump 22 for pumping the fluid 9 from the reservoir 12 to the gap 15 for ignition. Switches identified as $S_1$ and $S_2$ are switches which generate respective voltages to the respective first and second electrodes 14*a*,14*b* via the respective exemplary circuits schematically illustrated in FIGS. 4A–4C as a remote feature. Light extinguishing features include a single or auxiliary micro-valve which generates a flux of air via the micro-pump 22 to extinguish the candle light at the gap 15. The micro-controller can be programmed to extinguish the candle at 1, 2, or 4 hours or by remotely or manually deactivating the lamp accordingly. Thus, the touch switch 18*a* located at the base 10 of the candle will extinguish the flame. An A/C power pack adapter can be used to keep rechargeable batteries such as Nickel Metal Hydride or Cadmium sufficiently charged. This particular design of the micro-controlled oil lamp system 5 can be linked to form a plurality of candles to produce more than one candle light flame. Circuit synchronization can be formed such that a single signal can cause the flames to be extinguished or activated simultaneously or alternately according to a predetermined sequence. Other salient points of the invention are directed to the way the candle is lit. That is, butane gas from a closed reservoir serves to ignite a liquid paraffin.

It is to be understood that the present invention is not limited to the sole embodiments described above, but encompasses any and all embodiments within the scope of the following claims.

We claim:

1. A remote micro-controlled oil lamp, comprising:

a base having a reservoir, a wick in fluid communication with said reservoir and a housing for said wick, said base further comprising an activation circuit, an audible circuit, and a pump for pumping a combustible fluid from the reservoir to the wick, wherein said wick includes a first electrode, a second electrode and a fluid channel, said first electrode and said second electrode being integrally mounted to opposing walls of the channel such that a gap of predetermined distance is formed;

means for controlling said pump, said controlling means having a power source operatively connected to said pump;

means for detecting an illumination source of a predetermined characteristic wavelength for activating said activation circuit and said audible circuit; and means for manually activating said activation and audible circuits.

2. The remote micro-controlled oil lamp according to claim 1, wherein said fluid channel is a substantially cylindrical channel.

3. The remote micro-controlled oil lamp according to claim 2, wherein said fluid channel is a substantially cylindrical channel having the gap of predetermined distance equivalent to a selective diameter for said cylindrical channel.

4. The remote micro-controlled oil lamp according to claim 1, wherein said fluid is a liquid paraffin.

5. The remote micro-controlled oil lamp according to claim 1, wherein said fluid is butane.

6. The remote micro-controlled oil lamp according to claim 1, wherein the reservoir, wick and housing are disposed on the base as nested concentrically arranged elements.

7. The remote micro-controlled oil lamp according to claim 6, wherein the housing is a substantially cylindrically shaped housing.

8. The remote micro-controlled oil lamp according to claim 1, wherein the housing is made of lead crystal.

9. The remote micro-controlled oil lamp according to claim 1, further comprising a remote controlled illumination source for activating and deactivating the lamp.

10. A remote micro-controlled oil lamp, comprising:

a base having a reservoir, a wick in fluid communication with said reservoir and a housing for said wick, said base further comprising an activation circuit, an audible circuit, and a pump for pumping a combustible fluid from the reservoir to the wick, wherein said wick includes a first electrode, a second electrode and a fluid channel, said first electrode and said second electrode being integrally mounted to opposing walls of the channel such that a gap of predetermined distance is formed;

means for controlling said pump, said controlling means having a power source operatively connected to said pump;

a remote unit for providing an illumination source having a predetermined characteristic wavelength;

detector means for detecting the illumination source to activate said activation circuit and said audible circuit; and means for manually activating said activation and audible circuits.

11. The remote micro-controlled oil lamp according to claim 10, wherein said fluid channel is a substantially cylindrical channel.

12. The remote micro-controlled oil lamp according to claim 11, wherein said fluid channel is a substantially cylindrical channel having the gap of predetermined distance equivalent to a selective diameter for said cylindrical channel.

13. The remote micro-controlled oil lamp according to claim 10, wherein said fluid is a liquid paraffin.

14. The remote micro-controlled oil lamp according to claim 10, wherein said fluid is butane.

15. The remote micro-controlled oil lamp according to claim 10, wherein the reservoir, wick and housing are disposed on the base as nested concentrically arranged elements.

16. The remote micro-controlled oil lamp according to claim 15, wherein the housing is a substantially cylindrically shaped housing.

17. The remote micro-controlled oil lamp according to claim 10, wherein the housing is made of lead crystal.

* * * * *